US005941085A

United States Patent [19]

Jeon

[11] Patent Number: 5,941,085

[45] Date of Patent: Aug. 24, 1999

[54] REFRIGERATOR HAVING AN APPARATUS FOR DEFROSTING

[75] Inventor: Yong-Deok Jeon, Incheon, Rep. of Korea

[73] Assignee: Daewoo Electronics Co., Ltd., Rep. of Korea

[21] Appl. No.: 08/994,658

[22] Filed: Dec. 19, 1997

[30] Foreign Application Priority Data

Jun. 30, 1997 [KR] Rep. of Korea ..... 97-29919

[51] Int. Cl.[6] ..... F25B 47/02

[52] U.S. Cl. ..... 62/151; 62/277; 62/81; 62/276

[58] Field of Search ..... 62/151, 155, 156, 62/513, 113, 277, 278, 177, 179, 180, 234, 275, 276

[56] References Cited

U.S. PATENT DOCUMENTS

| | | | |
|---|---|---|---|
| 2,526,032 | 10/1950 | La Porte | 62/277 X |
| 2,693,682 | 11/1954 | Winger et al. | 62/277 X |
| 4,420,943 | 12/1983 | Clawson | 62/81 |
| 5,400,615 | 3/1995 | Pearson | 62/277 |
| 5,727,393 | 3/1998 | Mahmoudzadeh | 62/81 |

*Primary Examiner*—Harry B. Tanner
*Attorney, Agent, or Firm*—Pillsbury Madison & Sutro, LLP

[57] ABSTRACT

A refrigerator having an apparatus for defrosting. The refrigerator provides an apparatus for defrosting which uses a wasted heat from a compressor. The apparatus has a container placed on an upper surface of the compressor and an antifreezer solution for absorbing and storing the wasted heat from the compressor by performing a heat exchange. A pipe and a pump for circulating the fluid via a space section is provided. In the space section, the pipe is formed with a bending portion so as to transfer a heat to a surrounding air. In addition, a valve for preventing a high temperature air from flowing into a freezer compartment while a defrost operation is being carried out, and a plate for preventing a cabinet from being melted are provided. The refrigerator according to the present invention can carry out a defrost operation by both heater and a wasted heat of a compressor, thereby reducing the power consumption thereof and reducing the time required for the defrost operation, and also provide a valve for preventing an air with high temperature from flowing into a freezer compartment, thereby preventing the temperature of the freezer compartment from being raised.

9 Claims, 3 Drawing Sheets

REFRIGERATOR HAVING AN APPARATUS FOR DEFROSTING

BACKGROUND OF THE INVENTION

1. Field of the Invention

The present invention relates to a refrigerator, and more particularly to a refrigerator which can effectively remove a frost formed at an outer surface of an evaporator by using a wasted heat generated from a compressor.

2. Description of the Prior Art

Generally, a refrigerator is a device for storing foodstuffs at a relatively low temperature in order to maintain a freshness of the foodstuff. The refrigerator comprises a compressor, a condenser, an expansion valve and an evaporator. It is common knowledge that a working fluid called as a refrigerant circulates through a thermodynamic cycle. In such systems, a low pressure refrigerant is compressed by the compressor and leaves the compressor as a vapor at an elevated pressure, and then condenses in the condenser, resulting in a transfer of a heat to an environment surrounding the condenser. High pressure liquid refrigerant then passes through the expansion valve in which some of the liquid refrigerant flashes into vapor. The remaining refrigerant is vaporized in the low pressure evaporator, resulting in a transfer of a heat to the evaporating refrigerant from the environment, thereby cooling a surrounding air. The chilled air generated at a periphery of the evaporator is blown into a freezer compartment by a fan. The refrigerant vapor is then drawn into the compressor, and the cycle begins again. In short, in the evaporator, the refrigerant absorbs a heat from the surroundings and, in the condenser, it gives a heat off.

During the cooling cycle, ice builds up on an outer surface of the evaporator because the temperature of an outer wall of the evaporator is substantially below the freezing point of water. Accumulated ice may act as an insulator and provide a thermal barrier which interferes with the heat transfer between the refrigerant in the evaporator and the outside environment. This in turn results in a significant decrease in the efficiency of the refrigerator. Accordingly, the compressor has to work harder and longer to provide the required thermodynamic cycle. Also, further energy is required to melt the ice.

Generally, automatic defrosting refrigerators use a heat from an external source to melt the ice. Typically, a resistive heating element is connected to the evaporator or mounted in a position adjacent thereto. Then, in response to a timer, electric current is passed through the element during an off cycle of the compressor.

FIG. 1 shows a conventional refrigerator 100 having a heater 170.

As shown in FIG. 1, refrigerator 100 comprises a cabinet 110. Cabinet 110 is formed therein with a refrigerating compartment 130 for receiving foodstuffs which are to be maintained fresh at a relatively low temperature and a freezer compartment 120 for receiving foodstuffs which are to be maintained in a frozen state. Freezer compartment 120 is formed at a rear portion thereof with a space section 140, in which an evaporator 160 for generating a chilled air is installed. Refrigerating and freezer compartment 130 and 120 are divided by a wall section 152, and freezer compartment 120 and space section 140 are divided by a wall section 150.

A compressor(not shown) is installed below refrigerating compartment 130 for compressing and circulating the refrigerant. Vapor-phase refrigerant with high pressure and high temperature which has passed through the compressor gives a heat to a surroundings in the condenser(not shown), and is condensed into liquid phase. The liquid-phase refrigerant then passes through the expansion valve(not shown) in which some of the liquid-phase refrigerant flashes into vapor. The remaining refrigerant is vaporized in the low pressure evaporator 160 installed in a predetermined position in space section 140, resulting in a transfer of heat to the evaporating refrigerant from the environment, thereby cooling a surrounding air.

Wall section 150 is formed at an upper portion thereof with an opening 155 for introducing the chilled air generated by the evaporator into freezer compartment 120. A fan 180 driven by a motor 185 is installed in space section 140 at a position corresponding to a position of opening 155 for smoothly blowing a portion of the chilled air generated at a periphery of evaporator 160 into freezer compartment 120. The rest of the chilled air flows into refrigerating compartment 130 through a passage 145 formed in a rear wall of cabinet 110.

The chilled air flown into the refrigerating and freezer compartment 130 and 120 absorbs a heat from stored foodstuffs and returns to space section 140 through return passages 135 and 125 formed at wall section 152 so as to be cooled again in the above-described manner.

Meanwhile, a heater 170 is provided adjacent to evaporator 160 for removing a frost formed at an outer surface of evaporator 160, and is operated while a defrost operation is being carried out.

Heater 170 melts the ice by using a radiant heat radiated therefrom, and at this time, the temperature of an outer wall of heater 170 rises to an order of, for example, 400 degrees in Celsius. To prevent the radiant heat, radiated from heater 170, from being transferred into freezer compartment 120, wall section 150 is made of an insulator.

However, in the conventional refrigerator having heater 170, only a part of a power is consumed by heater 170 for defrosting, and the rest of the power is radiated into freezer compartment 120. The rest of the power is radiated into freezer compartment 120 through opening 155 formed at wall section 150, thereby raising the temperature of freezer compartment 120. To compensate for the rise in temperature of freezer compartment 120, a conventional refrigerator drops the temperature of freezer compartment 120 to 20 degrees below zero before carrying out the defrost operation, so an efficiency of a refrigeration is decreased and a power consumption is increased.

Meanwhile, U.S. Pat. No. 4,420,943 issued to Lawrence G. Clawson on Dec. 20, 1983 employs a thermal mass which is located in parallel with a condenser and receives a compressed refrigerant from a compressor. The compressed refrigerant transfers a heat to the thermal mass which stores the heat for a subsequent defrost operation. During the defrost operation, the compressor is deactivated and a solenoid valve is opened to fluidly connect the thermal mass to the outlet of the evaporator in bypass of the compressor. With this bypass valve opened, the pressure of the evaporator and the condenser equalize to an intermediate pressure. The refrigerant in contact with the thermal mass boils at the reduced pressure, thereby drawing a heat from the thermal mass. The vaporized refrigerant flows through the bypass valve to the evaporator and condenses in the relatively cool environment, thereby giving off heat to the evaporator, which melts the ice on an outer surface of the evaporator. However, the pressure equalization results in an undesirable heat transfer from the surroundings to the condenser.

Moreover, because the thermal mass is located in parallel with the condenser, it does not in any way facilitate a cooling of the liquid refrigerant being circulated through the system during the normal thermodynamic cycle taking place while the compressor is operating, and thus does not increase the overall efficiency of the refrigerator during a normal operation.

SUMMARY OF THE INVENTION

The present invention is intended to overcome the above described disadvantage. Therefore, it is an object of the present invention to provide a refrigerator having an apparatus for defrosting which can effectively remove an ice formed at an outer surface of an evaporator by using a wasted heat generated at a compressor.

In order to achieve the above object of the present invention, there is provided a refrigerator comprising:

- a cabinet having a refrigerating compartment, a freezer compartment formed at an upper portion of the refrigerating compartment, and a space section formed at a rear of the freezer compartment and separated from the freezer compartment by a partition wall which is formed at a predetermined position thereof with an opening;
- a compressor for compressing and circulating a refrigerant, the compressor being installed below the refrigerating compartment;
- an evaporator for generating a chilled air, the evaporator being installed at a predetermined position in the space section;
- a fan for blowing the chilled air generated at a periphery of the evaporator into the freezer compartment, the fan being installed in the space section at a position corresponding to a position of the opening;
- a heater for heating the evaporator when a defrost operation is being carried out, the heater being located adjacent to the evaporator;
- a first means for absorbing and storing a wasted heat generated from the compressor;
- a second means for heating the space section by circulating the wasted heat stored in the first means when the defrost operation is being carried out; and
- a third means for preventing an air in the space section from flowing into the freezer compartment when the defrost operation is being carried out.

The first means includes a container placed on a top surface of the compressor and a fluid disposed in the container, the container absorbs the wasted heat from the compressor by a conduction and the fluid absorbs the wasted heat from the container by conductive and convective heat exchanges therebetween.

According to the preferred embodiment of the present invention, the fluid includes an antifreezing solution such as ethylene glycol and propylene glycol.

The second means includes a pipe which makes a closed loop together with the container and upwardly extends to the space section such that a portion thereof passes through the space section, and a pump for circulating the fluid through the pipe, the pump being connected to a predetermined part of the pipe, the pipe having a first end connected to a side wall of the container and a second end communicated with an upper portion of the container.

According to the preferred embodiment of the present invention, the portion of the pipe passing through the space section is formed with a bending portion which is bent a plurality of times for facilitating a heat exchange with the air in the space section.

The third means includes a valve for closing the opening when the defrost operation is being carried out, the valve being installed between the opening and the fan in the space section.

The compressor, the heater and the valve are electrically connected to an ECU and when the defrost operation begins, the compressor receives a stop signal from the ECU so as to be stopped, and the valve receives an operating signal from the ECU so as to close the opening.

The refrigerator further comprises a plate secured to an edge of a rear portion of the pipe in order to prevent the cabinet from being melted by a radiant heat radiated from both the heater and the pipe while the defrost operation is being carried out.

According to the preferred embodiment of the present invention, the plate is made of aluminum.

The refrigerator having an apparatus for defrosting according to the present invention can carry out a defrost operation by both a heater and by a wasted heat of a compressor, thereby reducing a power consumption thereof and reducing a time required for the defrost operation.

Also, the refrigerator according to the present invention provides a valve for preventing an air with high temperature from flowing into a freezer compartment, thereby preventing the temperature of the freezer compartment from being raised.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a refrigerator having an apparatus for defrosting according to a preferred embodiment of the present invention will be explained in more detail with reference to the accompanying drawings.

Elements which are the same as conventional elements will be referred to with the same numerals.

Figure 1:
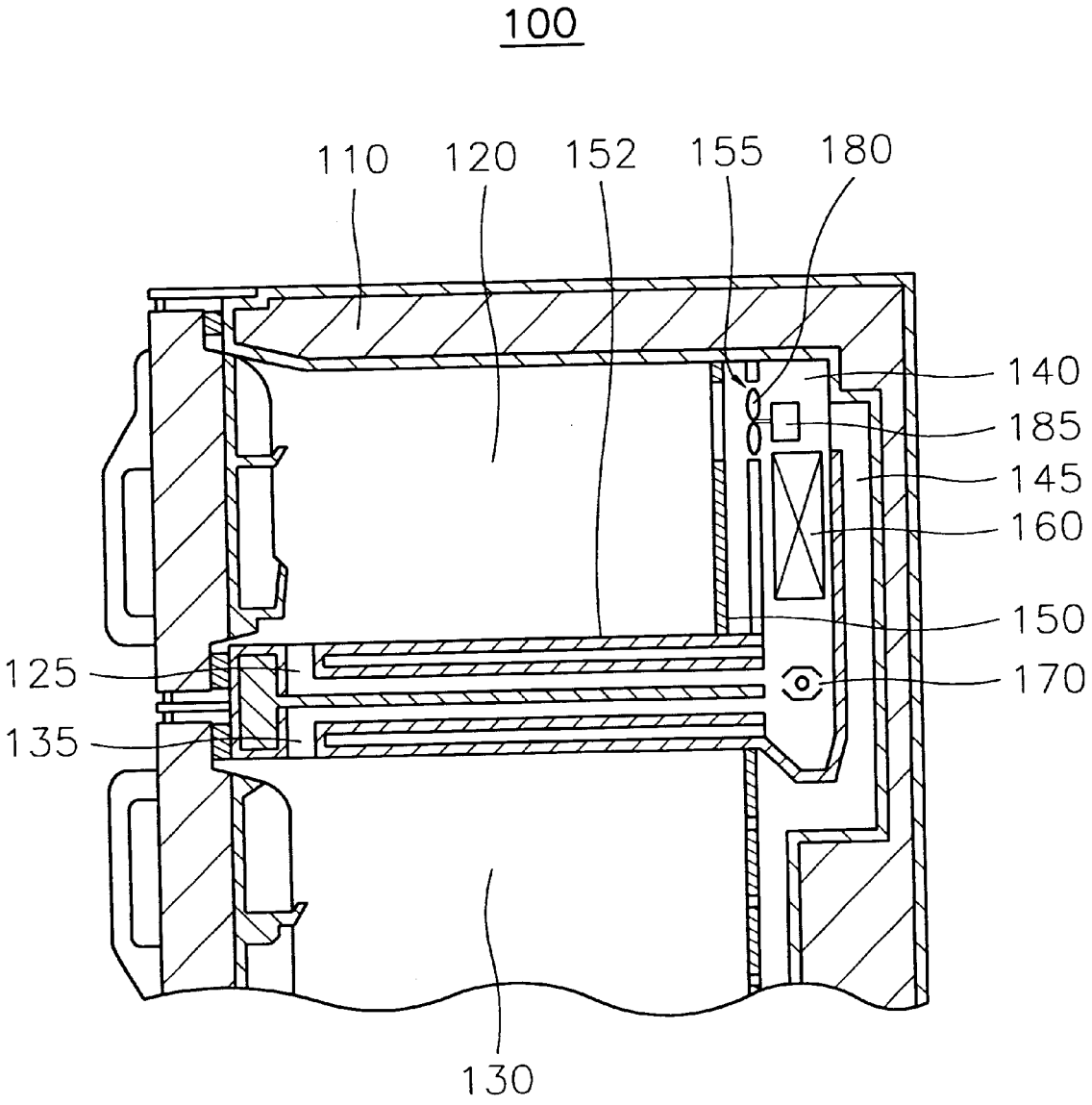
FIG. 1 (PRIOR ART)
FIG. 1 is a cross-sectional view showing an inner structure of a conventional refrigerator.
Figure 2:
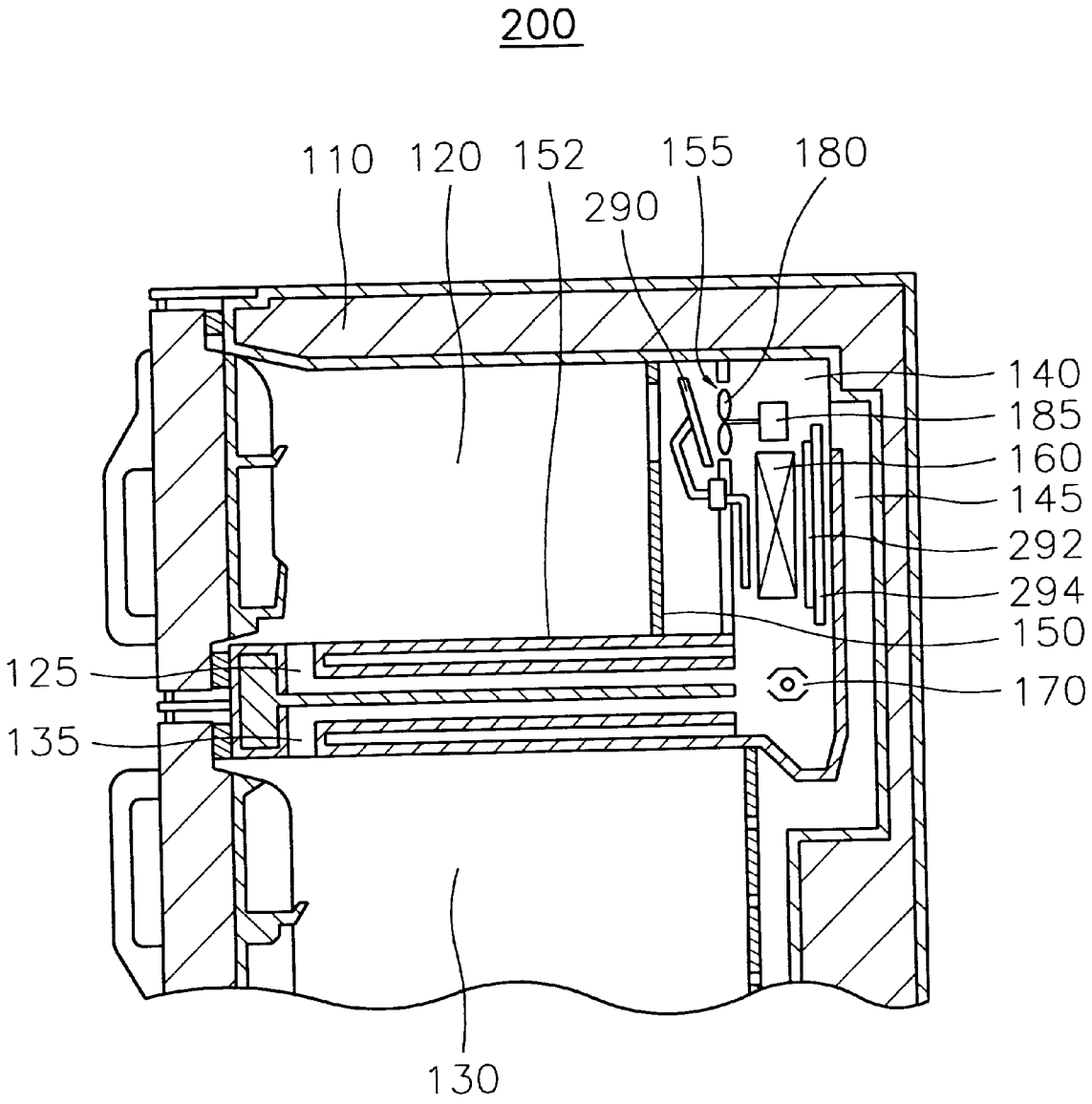
FIG. 2 is a cross-sectional view showing an inner structure of a refrigerator according to the present invention.
Figure 3:
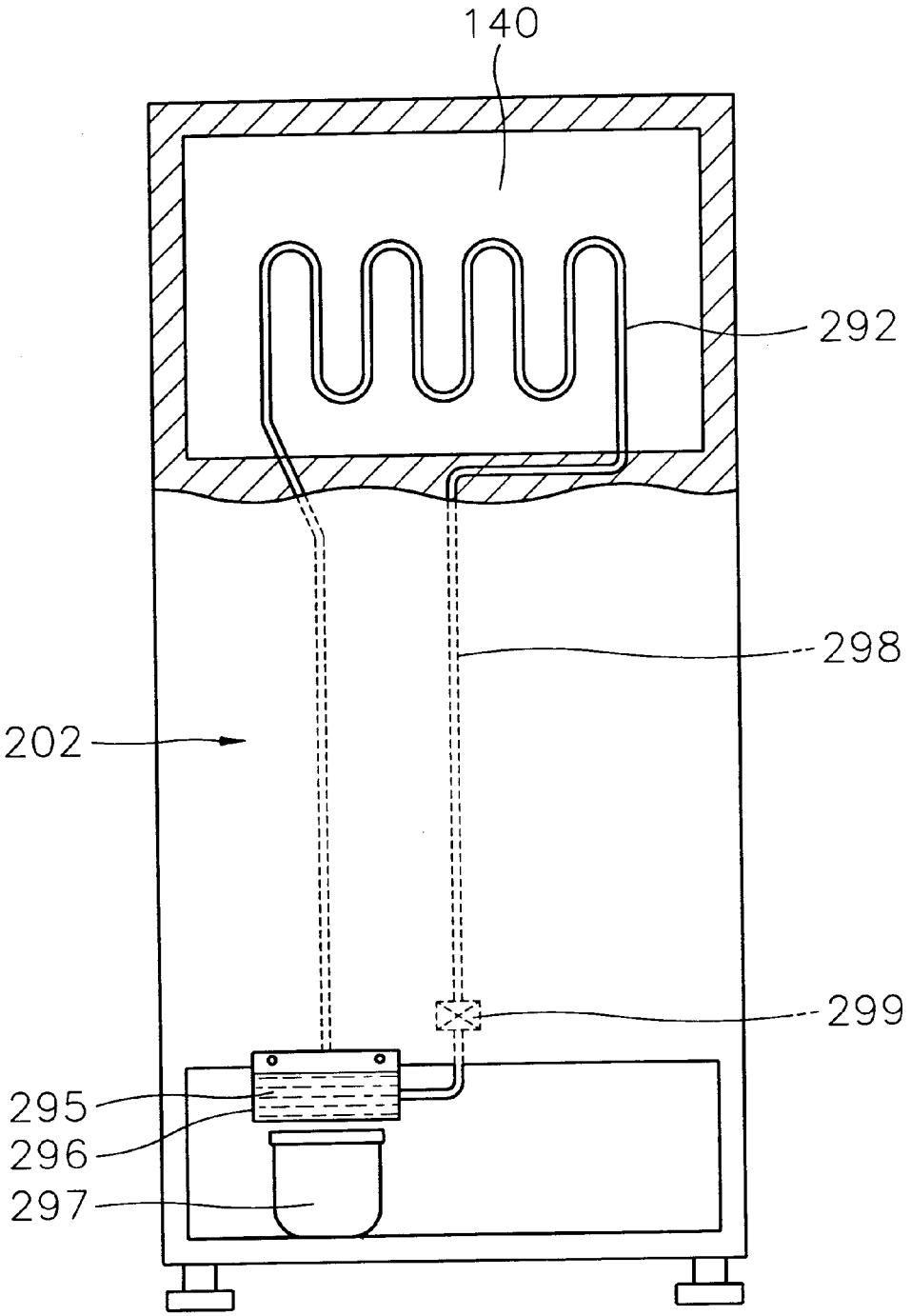
FIG. 3 is a cross-sectional view showing an apparatus for defrosting according to the present invention.

FIG. 2 and FIG. 3 shows a refrigerator 200 having an apparatus for defrosting 202 according to the present invention.

As shown in FIG. 2, refrigerators 200 comprises cabinet 110. Cabinet 110 is formed therein with a refrigerating compartment 130 for receiving foodstuffs which are to be maintained fresh at a relatively low temperature and a freezer compartment 120 for receiving foodstuffs which are to be maintained in a frozen state. Freezer compartment 120 is formed at a rear portion thereof with a space section 140, in which an evaporator 160 for generating a chilled air is installed. Refrigerating and freezer compartment 130 and 120 are divided by a wall section 152, and freezer compartment 120 and space section 140 are divided by a wall section 150.

Wall section 150 is formed at an upper portion thereof with an opening 155 for introducing the chilled air generated by evaporator 160 into freezer compartment 120. A fan 180 driven by a motor 185 is installed in space section 140 at a position corresponding to a position of opening 155 for smoothly blowing a portion of the chilled air generated at a periphery of evaporator 160 into the freezer compartment. The rest of the chilled air flows into refrigerating compartment 130 through a passage 145 formed in a rear wall of cabinet 110.

The chilled air flown into the refrigerating and freezer compartment 130 and 120 absorbs a heat from stored foodstuffs and returns to space section 140 through return passages 135 and 125 so as to be cooled again in the above-described manner.

Meanwhile, a heater 170 is provided adjacent to evaporator 160 for removing an ice formed at an outer surface of evaporator 160, and is operated while a defrost operation is being carried out.

An apparatus for defrosting 202 according to the present invention, as shown in FIG. 3, uses a wasted heat from a compressor 297 when the defrost operation is being carried out. As a means for absorbing and storing a wasted heat generated from compressor 297, a container 296 and a fluid 295 disposed in container 296 are provided. Container 296 is placed on a top surface of compressor 297 and absorbs the wasted heat from compressor 297 by a radiation and a conduction therebetween, and fluid 295 absorbs the wasted heat from container 296 by a conduction and a convection therebetween.

Fluid 295 is an antifreezing solution such as ethylene glycol and propylene glycol.

As a means for heating space section 140 by circulating the wasted heat stored in fluid 295 when the defrost operation is being carried out, a pipe 298 which makes a closed loop together with container 296 and upwardly extends to space section 140 such that a portion thereof passes through space section 140, and a pump 299 connected to a predetermined part of pipe 298 for circulating fluid 295 through pipe 298, are provided. One end of pipe 298 is connected to a side wall of container 296, and the other end is communicated with an upper portion of container 296.

As shown in FIG. 3, the portion of pipe 298 passing through space section 140 is formed with a bending portion 292 which is bent a plurality of times for facilitating a heat exchange with an air in space section 140.

While the defrost operation is being carried out, a plate 294 is secured to a rear edge of bending portion 292, as shown in FIG. 3, in order to prevent cabinet 110 from being melted by a radiant heat radiated from both heater 170 and bending portion 292. According to the preferred embodiment of the present invention, plate 294 is made of aluminum.

A valve 290 is provided in order to prevent a high temperature air in space section 140 from flowing into freezer compartment 120 while the defrost operation is being carried out. Valve 290 is installed between opening 155 formed at wall section 150 and fan 180 in space section 140 and closes opening 155 while the defrost operation is being carried out.

Compressor 297, heater 170, pump 299 and valve 290 are electrically communicated with an ECU(not shown), and when the defrost operation begins, compressor 297 receives a stop signal from the ECU so as to be stopped and valve 290 receives an operating signal from the ECU so as to close opening 155.

Hereinafter, the operation of refrigerator 200 having the apparatus for defrosting 202 according to the present invention will be explained.

When a defrost operation start signal is made by the ECU, compressor 297 is stopped and heater 170 is operated so as to radiate a radiant heat. Fluid 295 which has stored the wasted heat generated from compressor 297 during a normal cooling cycle, is circulated through pipe 298 by pump 299. Circulating fluid 295 passes through bending portion 292 located in space section 140 giving a heat stored therein to a surrounding air so as to heat space section 140, thereby melting the ice formed at evaporator 160.

As described above, the refrigerator having an apparatus for defrosting according to the present invention can carry out a defrost operation by both a heater and by a wasted heat of a compressor, thereby reducing a power consumption thereof and reducing a time required for the defrost operation.

Furthermore, the refrigerator according to the present invention provides a valve for preventing an air with high temperature from flowing into a freezer compartment, thereby preventing the temperature of the freezer compartment from rising.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a cabinet having a refrigerating compartment, a freezer compartment formed at an upper portion of the refrigerating compartment, and a space section formed at a rear of the freezer compartment and separated from the freezer compartment by a partition wall which is formed at a predetermined position thereof with an opening;

a compressor for compressing and circulating a refrigerant, the compressor being installed below the refrigerating compartment;

an evaporator for generating a chilled air, the evaporator being installed at a predetermined position in the space section;

a fan for blowing the chilled air generated at a periphery of the evaporator into the freezer compartment, the fan being installed in the space section at a position corresponding to a position of the opening;

a heater for heating the evaporator when a defrost operation is being carried out, the heater being located adjacent to the evaporator;

a first means for absorbing and storing a wasted heat generated from the compressor;

a second means for heating the space section by circulating the wasted heat stored in the first means while the defrost operation is being carried out; and a third means for preventing an air in the space section from flowing into the freezer compartment when the defrost operation is being carried out.

2. The refrigerator according to claim 1, wherein the first means includes a container placed on a top surface of the compressor and a fluid disposed in the container, the container absorbs the wasted heat from the compressor by conduction, and the fluid absorbs the wasted heat from the container by conductive and convective heat exchanges therebetween.

3. The refrigerator according to claim 2, wherein the fluid includes an antifreezing solution.

4. The refrigerator according to claim 2, wherein the second means includes a pipe which makes a closed loop together with the container and upwardly extends to the space section such that a portion thereof passes through the space section, and a pump for circulating the fluid through the pipe, the pump being connected to a predetermined part of the pipe, the pipe having a first end connected to a side wall of the container and a second end communicated with an upper portion of the container.

5. The refrigerator according to claim 4, wherein the portion of the pipe passing through the space section is formed with a bending portion which is bent plurality of times for facilitating a heat exchange with the air in the space section.

6. The refrigerator according to claim 4, wherein the third means includes a valve for closing the opening when the defrost operation is being carried out, the valve being installed between the opening and the fan in the space section.

7. The refrigerator according to claim 6, wherein the compressor, the heater and the valve are electrically connected to an ECU and when the defrost operation begins, the compressor receives a stop signal from the ECU so as to be stopped, and the valve receives an operating signal from the ECU so as to close the opening.

8. The refrigerator according to claim 4, the refrigerator further comprising a plate secured to an edge of a rear portion of the pipe in order to prevent the cabinet from being melted by a radiant heat radiated from both the heater and the pipe while the defrost operation is being carried out.

9. The refrigerator according to claim 8, wherein the plate is made of aluminum.

* * * * *